US009593845B2

(12) United States Patent
Lesage et al.

(10) Patent No.: US 9,593,845 B2
(45) Date of Patent: Mar. 14, 2017

(54) MONITORING MODULE FOR HOT WATER HEATER DIAGNOSTIC DEVICE

(75) Inventors: Jean-Claude Lesage, Kirkland (CA); Claude Lesage, Pointe Claire (CA)

(73) Assignee: MICLAU—S.R.I. Inc.

( * ) Notice: Subject to any disclaimer, the term of this patent is extended or adjusted under 35 U.S.C. 154(b) by 1080 days.

(21) Appl. No.: 13/109,038

(22) Filed: May 17, 2011

(65) Prior Publication Data

US 2011/0283958 A1 Nov. 24, 2011

(30) Foreign Application Priority Data

May 21, 2010 (CA) ..... 2705079

(51) Int. Cl.
*F22B 37/42* (2006.01)

(52) U.S. Cl.
CPC ..... *F22B 37/42* (2013.01)

(58) Field of Classification Search
CPC .... G08B 1/08; H05B 33/0803; H05B 25/167; H05B 33/0869
USPC ..... 122/504.2; 340/815.45, 815.6, 815.67
See application file for complete search history.

(56) References Cited

U.S. PATENT DOCUMENTS

| | | | | |
|---|---|---|---|---|
| 5,954,265 | A * | 9/1999 | Hall et al. | 236/94 |
| 6,512,820 | B1 * | 1/2003 | Weng | 379/102.05 |
| 2003/0058097 | A1 * | 3/2003 | Saltzstein et al. | 340/531 |

* cited by examiner

*Primary Examiner* — Alissa Tompkins
*Assistant Examiner* — John Bargero
(74) *Attorney, Agent, or Firm* — Guy J. Houle; Houle Patent Agency Inc.

(57) ABSTRACT

A monitoring module for connection to a diagnostic device having two or more light emitting sources for indicating operating fault conditions of an apparatus. The monitoring module feeds information signals to a communication link for reception at a remote location. The monitoring module is secured over a series of light emitting diodes of the diagnostic device and reproduces these for local access. The series of LED's indicate fault conditions of the apparatus which in this embodiment is a hot water heater. Accordingly, the operation of the hot water heater at its fault status can be monitored from a remote location and on site.

9 Claims, 3 Drawing Sheets

MONITORING MODULE FOR HOT WATER HEATER DIAGNOSTIC DEVICE

TECHNICAL FIELD

The present invention relates to a monitoring module for connection to a diagnostic device of an apparatus, such as a hot water heater, to transmit the status displayed by the diagnostic to a remote location and to simultaneously reproduce the status displayed.

BACKGROUND ART

Various types of diagnostic devices are known to monitor the operation of an apparatus such as a furnace, hot water heater, humidifier, etc. It is also known to transmit the monitored information to a remote location whereby the operation and status of the apparatus can be monitored. It is also known to provide diagnostic devices with a series of LED's which indicate proper operation of the apparatus or various fault conditions by the illumination of some of the LED's or causing some of the LED's to flash.

There is a need to provide a monitoring module which is capable of being secured to an existing diagnostic device having LED condition indicators and which can read the LED condition indicators, transmit their status to a remote location and reproduce them on the monitoring module for local display.

SUMMARY OF INVENTION

It is a feature of the present invention to provide a monitoring module which meets the existing need as above-mentioned.

Another feature of the present invention is to provide a monitoring module which is secured onto a diagnostic device of a hot water heater and which is capable of reading the status of a series of LED's, to reproduce that status by a further series of LED's provided on the monitoring module and to transmit the status of the LED's to a remote location.

It is also a feature of the present invention to provide a monitoring module also capable of sensing other malfunctions associated with hot water heaters such as CO or $CO_2$ emissions, water leaks, or the like alarm conditions.

It is a further feature of the present invention to provide a monitoring module incorporating therein a micro-controller and a sensor switch to generate an alarm condition if the monitoring module is incorrectly secured to the diagnostic module or if it is removed from the diagnostic module and wherein an audible alarm is associated with the sensor switch.

Another feature of the present invention is to provide a monitoring module for connection to a diagnostic device and having detection means to detect the illuminated condition of fault indicating light emitting diodes and to reproduce these by means of a detector circuit, or light conducting mediums.

According to the above features, from a broad aspect, the present invention provides a monitoring module for connection to a diagnostic device having two or more light emitting sources for indicating operating fault conditions of an apparatus. The monitoring module feeds information signals to a communication link for reception at a remote location. Means is provided to secure the monitoring module to the diagnostic device and disposed to conceal the two or more light emitting sources. The monitoring module has two or more visible corresponding light emitting sources duplicating the state of the two or more light emitting sources of the diagnostic device. Detection means is provided to illuminate one or more of the visible corresponding light emitting sources of the information transmitting module in response to one or more corresponding ones of the concealed two or more light emitting sources of the diagnostic device being lit.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
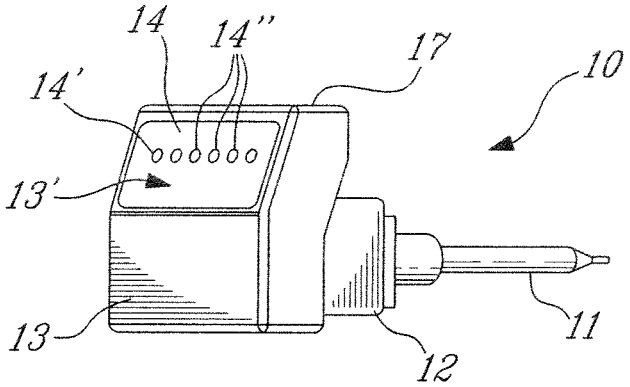
Fig-1 (PRIOR ART)
FIG. 1 is a perspective view of a prior art diagnostic device as used in conjunction with domestic hot water heaters.
Figure 6:
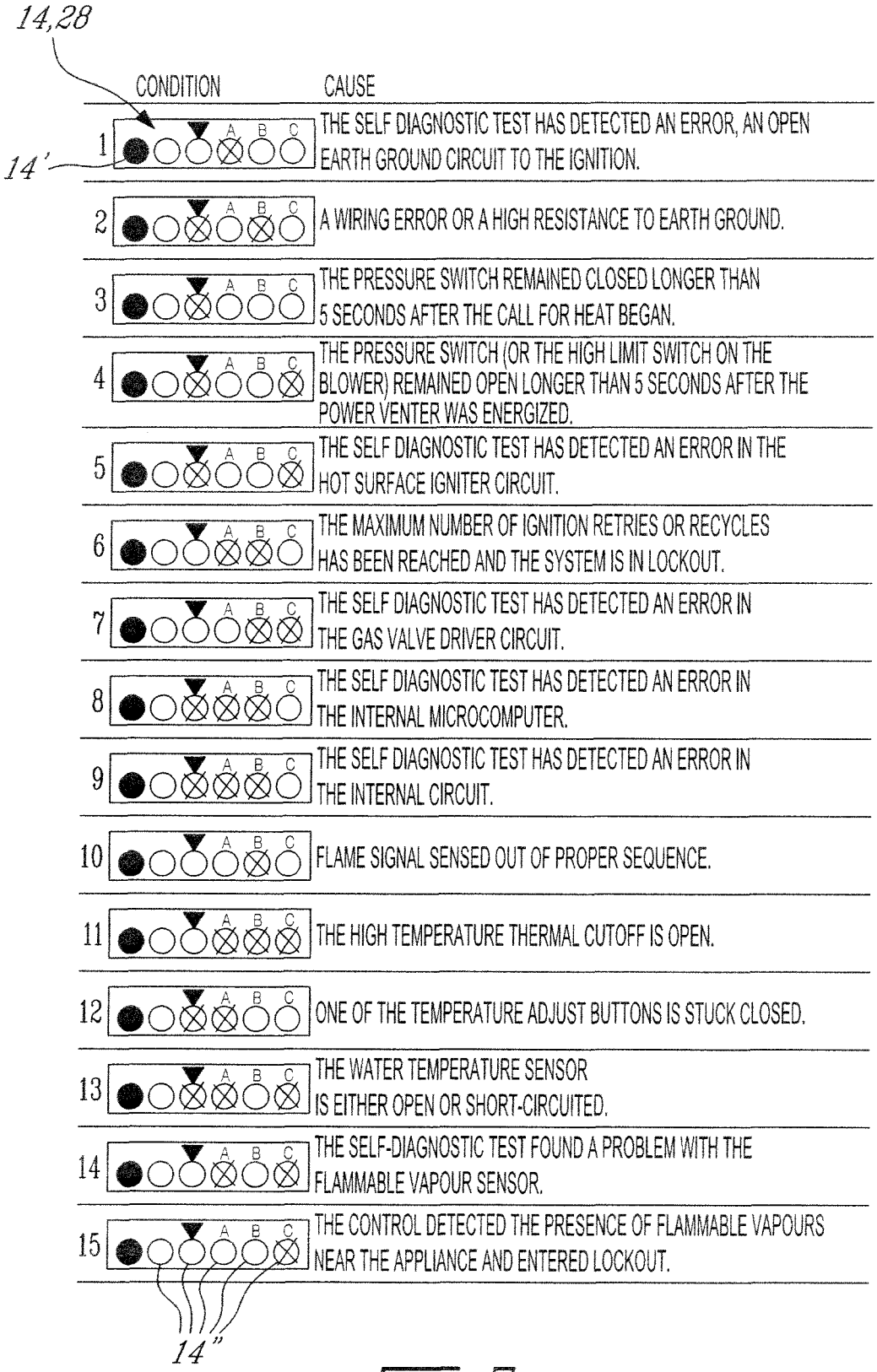
FIG. 6 is a chart showing the various light combinations of the LED's and its associated fault cause.

Referring now to the drawings and more particularly to FIG. 1, there is shown generally at 10 a diagnostic device of the type secured to a domestic hot water heater as is well known in the art and not illustrated herein. The diagnostic device is provided with a temperature probe 11, a connector 12 and a housing 13 in which is provided circuitry capable of monitoring various conditions of a hot water heater such as illustrated in the chart of FIG. 6. The housing 13 is provided with a series of LED lamps 14 which, when lit, displays a fault cause as illustrated in FIG. 6. In this particular application, LED 14' is a green flashing LED which indicates that the diagnostic device is operative. The other five LED's 14" are of another color, such as yellow, and when lit either singly or in combination, as illustrated in FIG. 6, provides a visual indication of a fault cause.

Figure 2:
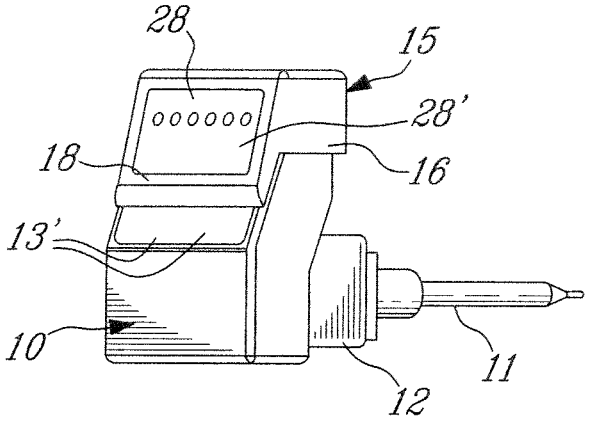
FIG. 2 is a perspective view, similar to FIG. 1, and showing the monitoring module of the present invention connected to the diagnostic device.

With reference now to FIG. 2, there is shown the monitoring module 15 of the present invention which is clamped, screwed, glued on or otherwise secured at a precise location on the diagnostic device 10. As hereinshown the monitoring module has a housing 16 which is configured to be secured on the top wall 17 of the diagnostic device 10 and a depending wall section 18 thereof is adapted to extend over the display panel having a series of light emitting diodes 14. It is important that the monitoring module 15 be substantially precisely positioned on the diagnostic device 10. The arrow touch switches 13' are ON and OFF switches.

Figure 3:
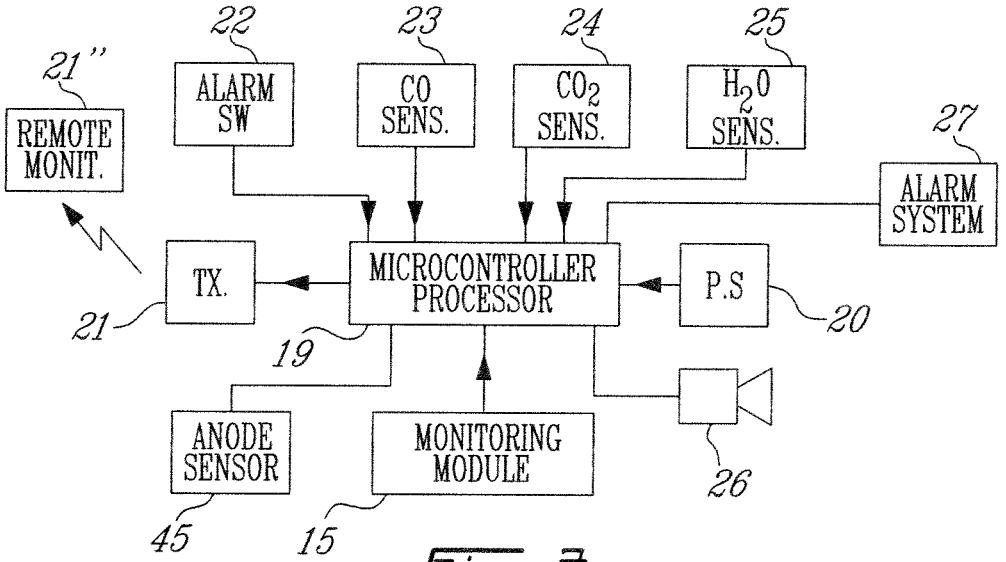
FIG. 3 is a simplified block diagram illustrating the micro-controller of the monitoring module and associated sensors, devices, systems and electrical supply.

Referring now to FIG. 3, there is shown a block diagram of the circuitry associated with the monitoring module 15 of the present invention. It incorporates therein a micro-controller circuit 19 which is driven by a power supply 20 which is in fact an AC/DC converter capable of producing supplies of 9 and 24 VCC. The power consumption of the circuitry is about 0.5 watts and the circuitry can operate under temperature of from 0 to 70° C. A transmitter 21 feeds information signals to a remote location 21" via wireless, internet, radio, or cellular communication link 21' whereby to provide signals indicative of the condition represented by the series of light emitting diodes 14' and 14".

An alarm sensor switch 22 is also associated with the circuitry and generates an audible local alarm 26 if the monitoring module 15 is not properly secured to the diagnostic device 10. This audible alarm is also reproduced at the remote location. CO and $CO_2$ sensors 23 and 24, respectively, also generate signals to the controller to provide local and remote alarms upon gas leak detection. A water detecting sensor 25 is provided to detect water leaks in the immediate area of the hot water heater and also provides an alarm signal to the micro-controller for generating the local audible alarm 26. An anode depletion detection sensor 45 is also monitored. The communication link may also be provided through an alarm company network 27 which is branched to monitor a domestic location whereby the monitoring is effected at a central location of the alarm company. The monitoring module may also be in communication with a water heater rental company which may have thousands of subscribers.

Figure 4:
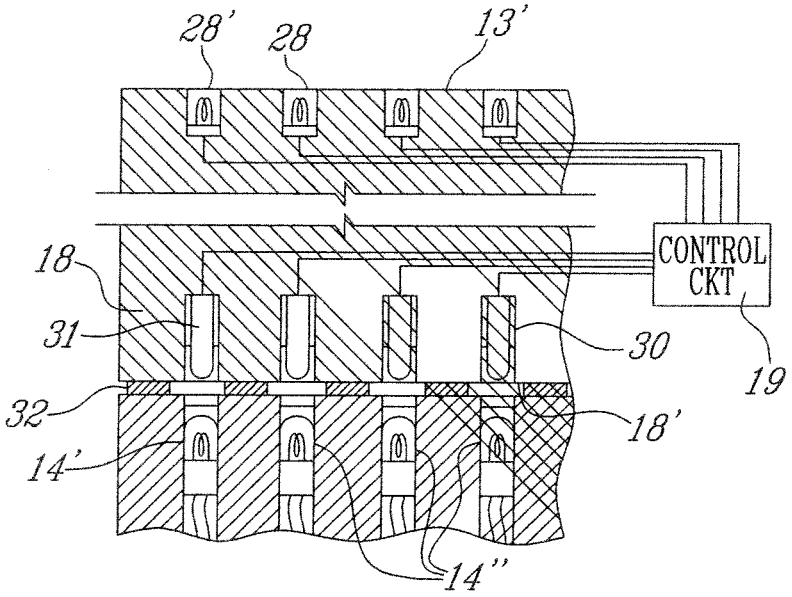
FIG. 4 is a simplified fragmented schematic view illustrating an embodiment by which the conditions of the light emitting diodes of the diagnostic device are monitored by the monitoring module and reproduced thereon.

As shown in FIG. 2, the monitoring module 15 is also provided with a series of LED's 28 which replicates the LED's 14 and 14" of the diagnostic device 10. This replication can be achieved by various detection means which detects the condition of the LED's 14 and cause the LED's 28 to illuminate to replicate the illuminated ones of the diodes 14. FIG. 4 illustrates one embodiment of the detection means. As shown in FIG. 4, the detection module is located inside a depending wall section 18 of the module 15 as shown, a series of cavities 30 in the module 15 are precisely aligned and spaced to be positioned adjacent the LED's 14 on the diagnostic device 10. Optical detectors 31, which may be photocells, detect the state of the LED's 14' and 14", lit or not lit, positioned thereagainst. In order to prevent light emission from adjacent LED's 14 and 14' to falsify the detection of the optical detectors 31, a gasket 32 is secured to the inner surface 18' of the depending wall section 18 to provide a seal about each of the LED's 14' and 14" whereby to isolate the LED's from one another whereby light emitted by the LED's will be detected only by a corresponding optical detector or photocell 31 positioned adjacent thereto. Upon detection of an associated one of the LED's being lit, a signal is sent to the control circuit or micro-controller 19 which in turn will light a corresponding LED 28 on the display surface 28' of the monitoring module 15. As previously described LED 14' indicates that the diagnostic device is functioning whereby the corresponding LED 28 will be lit or will flash when the LED 14' is lit.

Figure 5:
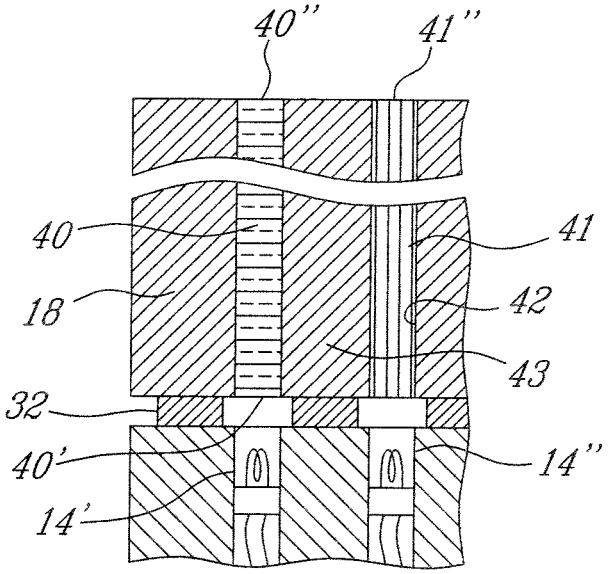
FIG. 5 is a schematic illustration of a further embodiment of sensing mediums capable of transmitting the light conditions of the LED's of the diagnostic device to a display on the monitoring module.

Referring now to FIG. 5, there is shown further embodiments of optical detectors and as hereinshown these are provided by isolated light conducting mediums, herein a glass rod 40 or an optical fibre bundle 41 capable of conducting light. In these embodiments the depending wall section 18 would be provided with elongated cavities 42 which may be straight cavities or curved cavities whereby to receive therein the glass rod or optical fiber bundle light conductors. On the other hand, the conductors may be isolated from one another by a light shielding material. As shown in FIG. 5, the light conductors are isolated from one another by the material 42 about the cavities 42 and their detecting end 40' and 41' are isolated from adjacent LED's 14 and 14' by the gasket 32. The opposed ends 40" and 41" of these light conducting mediums 40 and 41 constitute visual display ends to replicate the status of the LED's 14.

As shown in FIG. 6, there are six light emitting diodes 14 or 28, to indicate various errors to be detected by the diagnostic device 10 associated with the hot water heater. In this particular embodiment the LED 14' is a green LED which is always ON when the diagnostic device is functioning and the other five LED's are yellow LED's which, when lit solely or in combination as illustrated by the fifteen different causes displayed thereby, indicates a specific fault condition. The "x" represents the LED's.

It is within the ambit of the present invention to cover any obvious modifications of the embodiment described herein provided such modifications fall within the scope of the appended claims. For example, there are various securement means to interconnect the monitoring module 15 to the diagnostic device 10 such as clamps, adhesives, screws or brackets, not illustrated herein but obvious to a person skilled in the art. The important feature of the monitoring module is that it replicates the conditions of the LED's which are shielded by the monitoring module whereby the fault indicating LED's 14 can be monitored and displayed locally as well as at a remote location.

We claim:

1. A monitoring module for permanent connection to a diagnostic device having a display panel provided with two or more light emitting sources for indicating operating fault conditions of a water heater, said monitoring module feeding information signals through a communication link for reception at a remote location, said monitoring module comprising a housing permanently secured to said diagnostic device, said housing being provided with a housing section configured to extend over said display panel to conceal said two or more light emitting sources of said diagnostic device, said monitoring module having two or more visible light emitting sources corresponding to said two or more light emitting sources of said diagnostic device concealed by said housing section of said monitoring module to replicate locally on said housing the condition of said two or more light emitting sources of said diagnostic device for local display on said housing of the state of said concealed two or more light emitting sources of said diagnostic device, an isolated light conducting solid medium disposed at a detecting end adjacent respective ones of said two or more light emitting sources of said diagnostic device, said isolated light conducting solid medium having an opposed end terminating at an outer surface of said monitoring module and constituting said two or more light emitting sources of said monitoring module, and optical detectors in said monitoring module for detecting the condition of said two or more light emitting sources of said light conducting solid medium and providing said information signals fed to said remote location through said communication link.

2. The monitoring module as claimed in claim 1 wherein there are a plurality of said light emitting sources and visible corresponding light emitting sources, and wherein one or a combination of said concealed light emitting sources when lit provides an indication of a specific diagnostic condition of said apparatus.

3. The monitoring module as claimed in claim 2 wherein said light emitting sources of said diagnostic device are light emitting diodes.

4. The monitoring module as claimed in claim 1 wherein one of said two or more concealed light emitting sources concealed by said housing section, when lit, indicates that the diagnostic device is functional, the others of said concealed light emitting sources indicating fault conditions.

5. The monitoring module as claimed in claim 1 wherein said isolated light conducting mediums are constituted by fibre optics bundles isolated from one another.

6. The monitoring module as claimed in claim 1 wherein said isolated light conducting mediums are constituted by light transmitting glass rods.

7. The monitoring module as claimed in claim 1 wherein there is further provided a micro-controller circuit in said monitoring module, said micro-controller circuit having a processor for processing status and alarm signals, and a transmitter for transmitting said status and alarm signals to a remote location.

8. The monitoring module as claimed in claim 1 wherein said means to secure said monitoring module to said diagnostic device is one of a clamp, screws or adhesive.

9. The monitoring module as claimed in claim 7 wherein there is further provided a sensor switch associated with said monitoring module and micro-controller to generate an alarm condition if said monitoring module is incorrectly secured or removed from said diagnostic device, and an audible alarm associated with said monitoring module.

* * * * *